United States Patent [19]

Hirai

[11] Patent Number: 4,913,660

[45] Date of Patent: Apr. 3, 1990

[54] PRESSURE-CONTACT TYPE CONNECTOR FOR FLAT CABLE

[75] Inventor: Yuji Hirai, Yokohama, Japan

[73] Assignee: Honda Tsushin Kogyo Kabushiki Kaisha, Tokyo, Japan

[21] Appl. No.: 251,812

[22] Filed: Sep. 30, 1988

[30] Foreign Application Priority Data

Oct. 1, 1987 [JP] Japan ..... 62-149273

[51] Int. Cl.[4] ..... H01R 4/24

[52] U.S. Cl. ..... 439/396; 439/397

[58] Field of Search ..... 439/389, 391, 395, 396, 439/397, 417, 418

[56] References Cited

U.S. PATENT DOCUMENTS

| | | | |
|---|---|---|---|
| 4,009,922 | 3/1977 | Aysta | 439/405 |
| 4,270,831 | 6/1981 | Takahashi | 439/397 |
| 4,713,025 | 12/1987 | Soma | 439/391 X |
| 4,753,608 | 6/1988 | Yamaguchi | 439/395 |
| 4,767,352 | 8/1988 | Pretchel | 439/395 |

*Primary Examiner*—Z. R. Bilinsky

*Attorney, Agent, or Firm*—Birch, Stewart, Kolasch & Birch

[57] ABSTRACT

A pressure contact type connector for a flat cable wherein each conductor wire is pressed into U-shaped terminal members arranged in a first row and a second row. The terminal members in each of the first and second rows are disposed to form a zigzag arrangement having a pitch twice as large as the pitch of the conductor wires of the cable. The cable is arranged in a direction perpendicular to the direction of the terminal members. Each one of the terminal members in a first row is disposed to be shifted by one conductor wire arrangement pitch with respect to the corresponding one in the second row. A first cable housing includes a height at least equal to the length of a portion of the terminal member projecting out of an end surface of the contact housing and includes insertion through holes for the terminal members and a plurality of grooves disposed to cross the insertion through holes for receiving the terminal members and the conductor wire connecting portions for pressing into the terminal members. Both side edges of each strip-like top side surface between two adjoining side edges of the grooves form a cutting edge. A second cable housing includes a plurality of projections for mating with the plurality of grooves of the first cable housing. The projections are provided with insertion grooves for receiving the terminal members inserted thereinto. Both side edges of said second cable housing form a cutting edge.

5 Claims, 8 Drawing Sheets

PRESSURE-CONTACT TYPE CONNECTOR FOR FLAT CABLE

BACKGROUND OF THE INVENTION

1. Field of the Invention

This invention relates to a pressure-contact type connector for a flat cable and more specifically to such a connector that can be suitably used especially with a flat cable comprising conductor wires spaced very narrowly from one another.

2. Description of Background Art

There has been known hitherto a pressure-contact type connector for a flat cable such as one shown in FIGS. 14 and 15, wherein a plurality of contacts c, each of which has a terminal member a comprising three prism-shaped prongs b1, b2 and b3, are arranged in such a manner in a contact housing d made of an insulating material that their planar faces may be parallel to one another, and a conductor wire of the flat cable is inserted between the prongs b1, b2 and b3 as shown so as to be brought into pressure contact with the contact c.

According to the conventional connector described in the foregoing, a plurality of the terminal members a thereof can be arranged to have a smaller spacing from one another as compared with the other conventional type in which a plurality of such terminal members are arranged side by side so as to be aligned along their planar faces, so that it can be suitably used as a pressure-contact type connector for a flat cable comprising conductor wires arranged at such a small pitch as to be spaced from one another very narrowly, for example, by 0.635 mm. However, the prism-shaped prongs b1, b2 and b3 of the terminal member a are bent in the direction perpendicular to the planar face of the contact so as to be brought into pressure contact with a conductor wire of the cable, so that contact pressure thereof is rather weak..In addition, the prism-shaped prongs b1 and b2 of the terminal member a of one contact are located to have such a small spacing from the prism-shaped prong b3 of the other one that it is liable to have a problem of dielectric breakdown.

OBJECT AND SUMMARY OF THE INVENTION

It is, therefore, the object of the present invention to provide a pressure-contact type connector for a flat cable which is free from the above-mentioned problem and which facilitates connection operation of a flat cable.

To achieve the above object, the present invention provides a pressure-contact type connector for a flat cable in which each conductor wire of a flat cable is pressed into a U-shaped terminal member of each of plate-form contacts housed in a contact housing and which is characterized in that a plurality of the terminal members are arranged in two rows. The terminal members in each of the two rows are disposed so as to form a zigzag arrangement having a pitch twice as large as that at which the conductor wires of the cable are arranged in the direction perpendicular to that in which the terminal members are arranged, each one of the terminal members in one row being so disposed as to be shifted by one conductor arrangement pitch with respect to the corresponding one in the other row, there is provided a first cable housing whose height is at least equal to the length of a portion of the terminal member projecting out of an end surface of the contact housing and which has insertion through holes for the terminal members and a plurality of grooves disposed to cross the insertion through holes so that the terminal members and the conductor wires connecting portions which are to be pressed into the terminal members may be fitted thereinto. Both side edges of each strip-like top side surface between two adjoining ones of said grooves are formed so as to make a cutting edge. Further, a second cable housing is provided in which are formed a plurality of projections that fit into said plurality of grooves of the first cable housing, said projections being provided with insertion grooves for having the terminal members inserted thereinto and having both side edges thereof so formed as to make a cutting edge. The first cable housing is attached to the terminal members by having the terminal members inserted through the insertion through holes. When the second cable housing is placed on the first cable housing via a flat cable and is depressed, the plurality of projections thereof are inserted into the plurality of grooves of the first cable housing. A plurality of conductor wires of the flat cable are separated from one another by the cutting edge of the first cable housing and that of the second cable housing and brought into pressure contact with the terminal members for connection and at the same time become suitably bent.

Since a pitch at which one terminal member is spaced from the next in each row is twice as large as that for conductor wires of a flat cable, there occurs no dielectric breakdown even when conductor wires of the flat cable are so arranged at a very small pitch as to be very close to one another. As described in the foregoing, the first cable housing is attached to the terminal members by having the terminal members inserted through the insertion through holes and when the second cable housing is placed on the first cable housing via the flat cable and is depressed to have the plurality of projections thereof inserted into the plurality of grooves of the first cable housing, a plurality of conductor wires of the flat cable are separated from one another. Simultaneously, the conductor wires are brought into pressure contact with the terminal members for connection and suitably bent so as to have the wires led out from outside the terminal members in the other row.

DETAILED DESCRIPTION OF PREFERRED EMBODIMENT

A preferred embodiment example of the present invention will now be described more in detail in the following with reference to the accompanying drawings.

Figure 6:
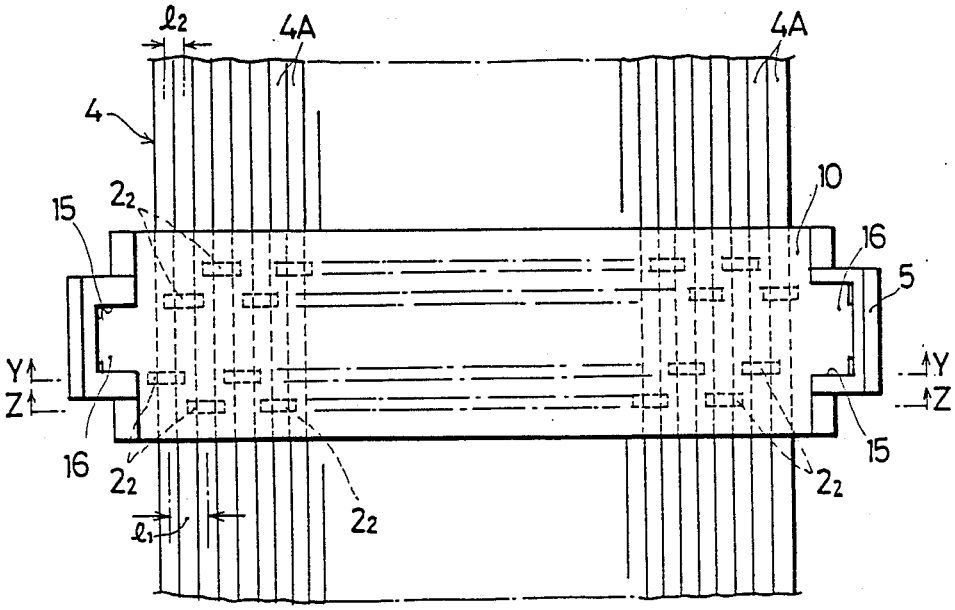

In the drawings, a contact housing 1 is made of an insulating material, in which a number of contacts 2 are arranged in two rows. The contact 2 comprises, as shown in FIGS. 10 through 13, a contact member $2_1$ and a terminal member $2_2$ which are connected to each other via either a longer small connecting piece 3*a* or a shorter small connecting piece 3*b* in such a way that the planar face of one member may be perpendicular to that of the other member. The terminal members $2_2$ are exposed from the lower end portion (that is, the upper side on the drawings) of the contact housing 1. Plural terminal members $2_2$ in each row are shifted alternately with one another in the widthwise direction of the contact housing 1 so that they may form a zigzag arrangement while plural contact members $2_1$ in each row are linearly arranged to have their planar face so positioned as to be opposed to one another. Both the contact member $2_1$ and the terminal member $2_2$ are U-shaped as are some of conventional ones. As shown in FIG. 6, an arrangement pitch $l_1$ at which a terminal member $2_2$ in each row is spaced from the next one is twice as large as a conductor wire arrangement pitch $l_2$ at which each conductor wire 4A of a flat cable 4 is spaced from the next one. The terminal member $2_2$ of one row is so disposed as to be shifted by one $l_2$ pitch with respect to the corresponding one of the other row as seen in relationship between the extreme left terminal members $2_2$ of the respective rows, for instance.

A first cable housing 5 is formed to have a length and a width equal to the length and width of the contact housing 1. The height is, for the most part thereof, somewhat greater than a length of the terminal member $2_2$ projecting out from the lower end surface of the contact housing 1. The first cable housing 5 is further provided with insertion through holes 6 for inserting the respective terminal members $2_2$ of said two rows therethrough. Grooves 7 are so disposed in the terminal member $2_2$ to cross the insertion through holes 6 so that connecting portions of the conductor wires 4A that are to be pressed into the terminal members $2_2$ may be fitted thereinto.

The insertion through hole 6 is perforated through the top side and underside surfaces of the first cable housing 5. The grooves 7 for the terminal members $2_2$ of one row are provided in the front half section of the first cable housing 5 and the grooves 7 for the terminal members $2_2$ of the other row are provided in the rear half section of the first cable housing 5. The grooves are formed to have, respectively, a predetermined depth sufficiently deep from the top side surface thereof as to allow, for instance, the groove bottom of the U-shaped terminal member $2_2$ to be exposed.

A plurality of the grooves 7A in the front half section and a plurality of the grooves 7B in the rear half section may be arranged alternately with each other. A side wall surface of the rear half portion of each of the grooves 7A in the front half section and a side wall surface of the front half portion of each of the grooves 7B in the rear half section are formed in the shape of an inclined surface 8, respectively. This inclined surface 8 and a strip-like top-side surface 9 of the rear half and the front half sections of the first cable housing 5 are so formed as to have an inwardly bent arc-shaped surface, respectively, in order to have both side edges formed as one of the cutting edges needed for cutting between the conductor wires 4A of the flat cable 4.

A second cable housing 10 including an underside surface facing the top side surface of the first cable housing 5 is provided with a plurality of projections 11A and 11B for insertion into the grooves 7 (7A and 7B). The projections 11A and 11B are provided with insertion grooves 12A, 12B for receiving the terminal members $2_2$ inserted thereinto. More specifically, as clearly shown in FIGS. 8 through 13, there are formed respectively on the front half and the rear half sections of the underside of the second cable housing the projections 11A and 11B which are adapted to mate, respectively, with the shapes of the grooves 7A and 7B provided on the front half and the rear half sections of the first cable housing.

The projections 11A and 11B are shifted by one $l_2$ pitch with respect to each other. In other words, the projections 11A are arranged so as to be separated from one another for so much as two $l_2$ pitches with respect to each other and the projections 11B are also arranged the same way with respect to each other.

Figure 3:
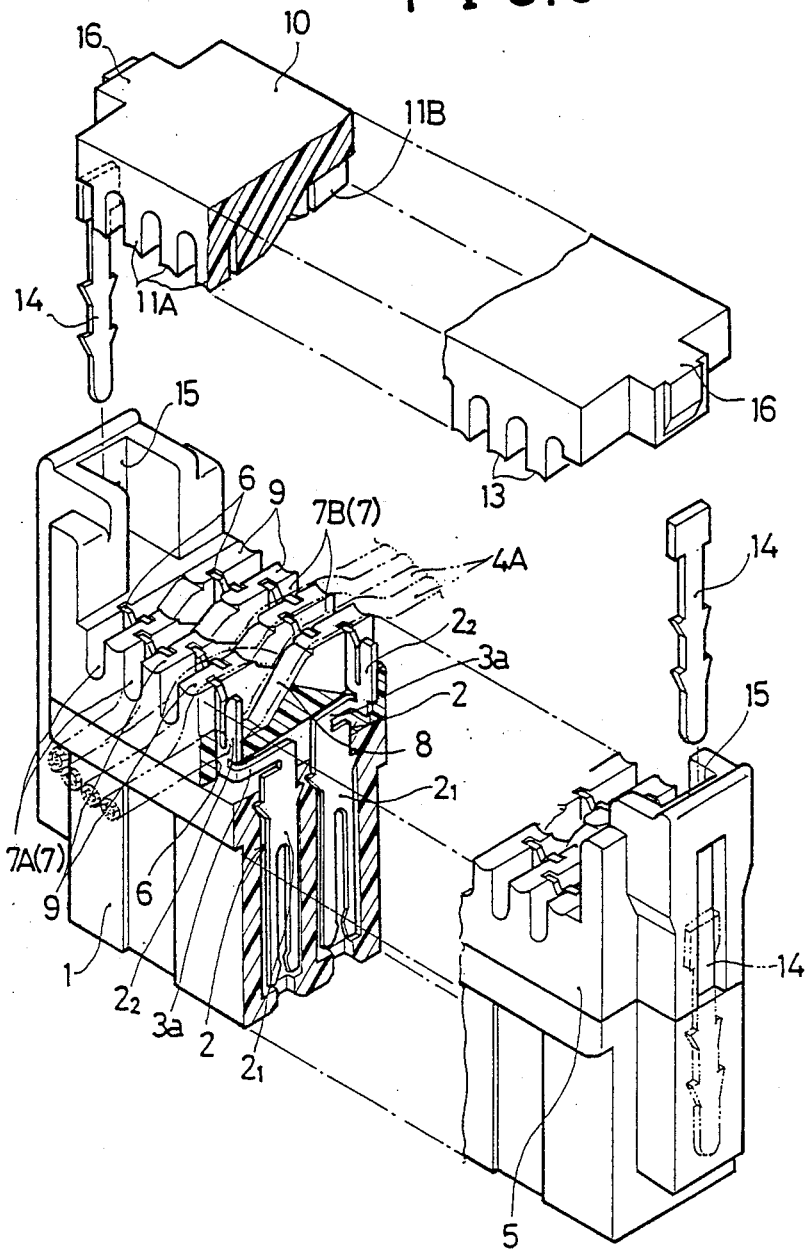
FIG. 3 is a perspective view thereof with a second cable housing separated from a first cable housing.
Figure 4:
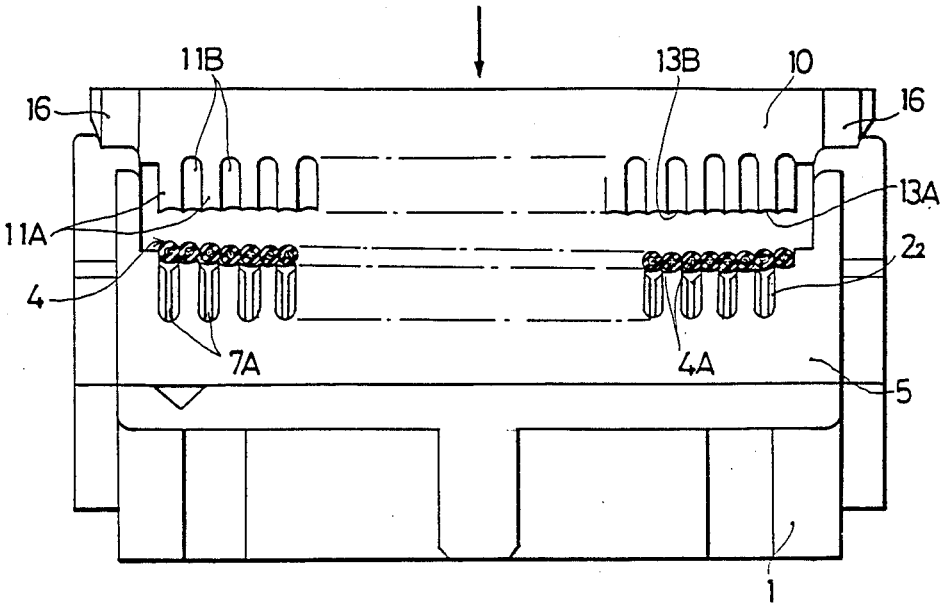
FIG. 4 is a front view thereof without a flat cable connected thereto.
Figure 5:
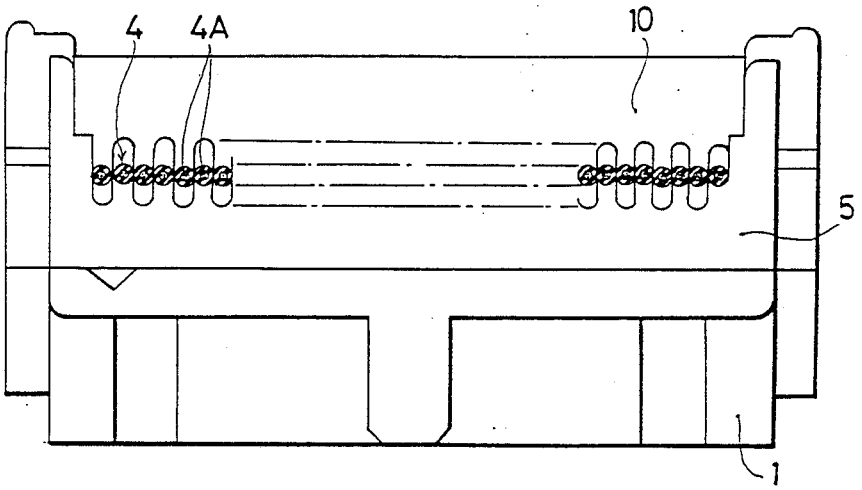
FIGS. 5, 6 and 7 are respectively front, plan and side views thereof with a flat cable connected thereto.

End surfaces 13A and 13B of the projections 11A and 11B are formed so as to have an inwardly bent arc-shaped surface, respectively, in order to have their side edges formed as the other cutting edges needed for cutting between the conductor wires 4A of the flat cable 4. Thus, as shown in FIGS. 3 and 4, the first cable housing 5 is fitted to the underside of the contact housing 1 by having the terminal members $2_2$ of the contact 2 projecting out from the underside of the contact housing 1 inserted through the insertion through holes. Then, as shown in FIG. 4, the flat cable 4 is placed on the first cable housing 5 in such a manner that the conductor wires 4A thereof may be coincided with the grooves 7A and 7B. Next, the second cable housing 10 is placed thereon in such a manner that the conductor wires 4A may coincide with the projections 11A and 11B, and thereafter pressed downwards, so that the flat cable 4 is cut between the conductor wires 4A thereof by the first cable housing 5 in cooperation with the second cable housing 10. As the second cable housing 10 is further depressed, the conductor wires 4A are pressed into the terminal members $2_2$ for connection and at the same time become bent according to the shapes of the grooves 7A and 7B, the inclined surface 8 and the top side surface 9.

Figure 1:
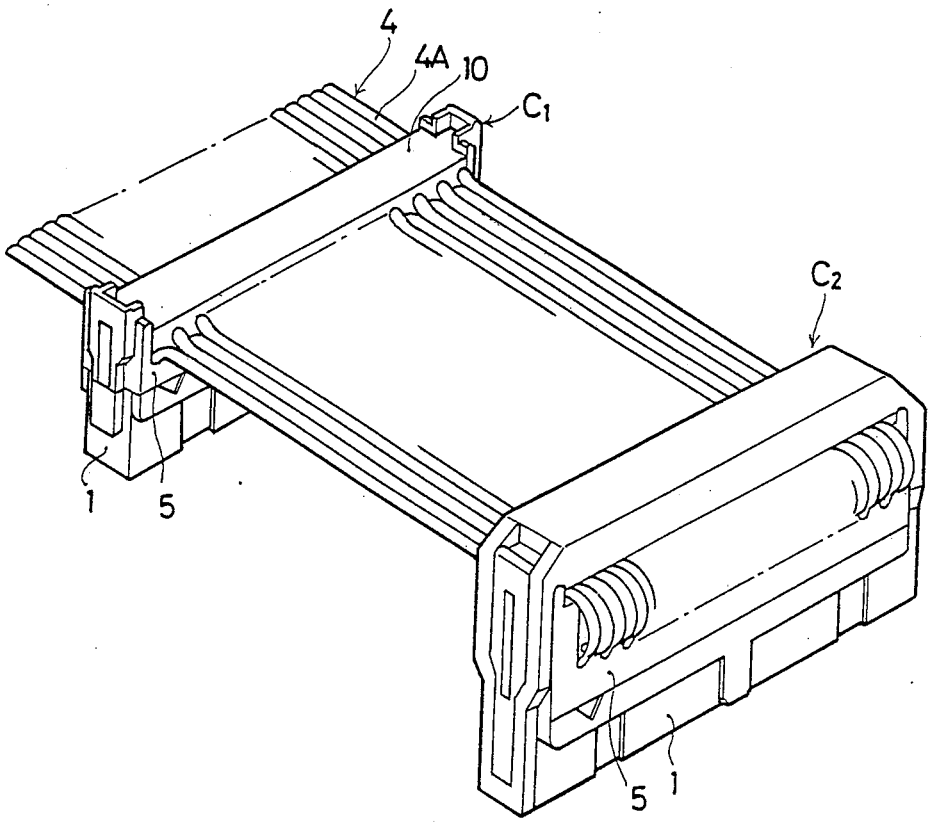
FIG. 1 is a perspective view of one embodiment of the present invention in which a flat cable is connected to the connectors according to the invention.
Figure 2:
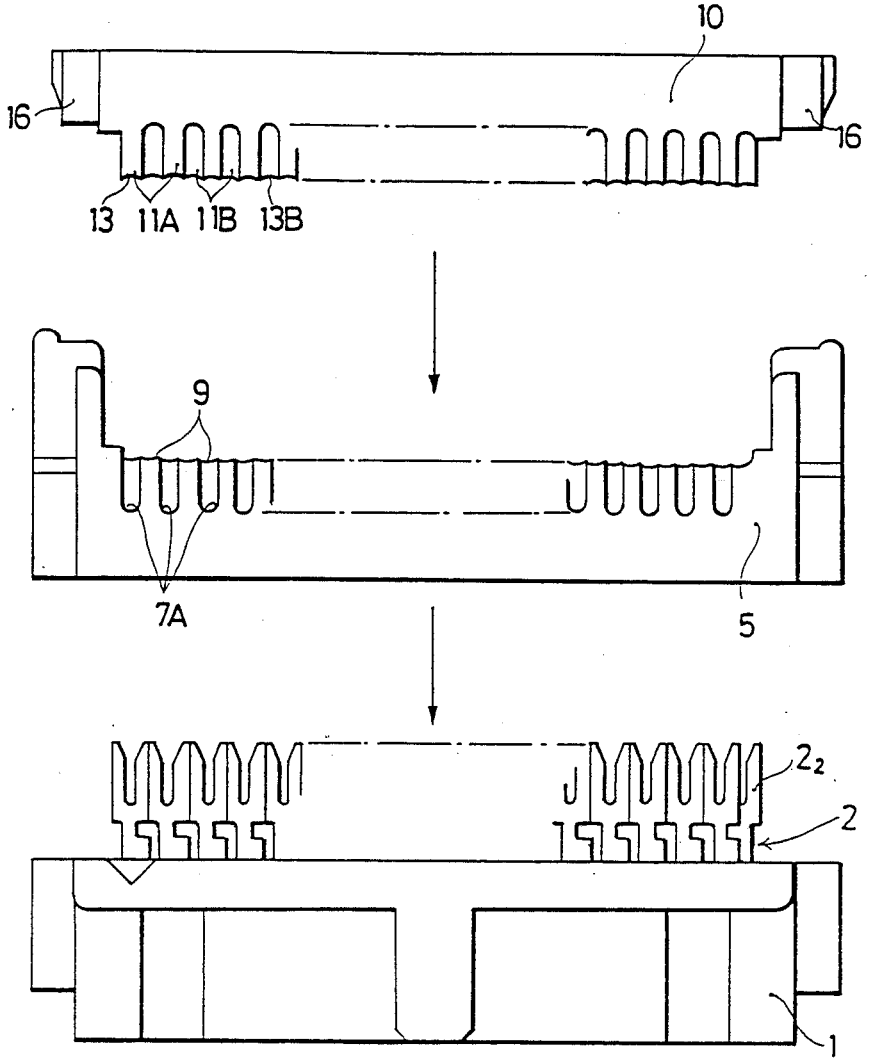
FIG. 2 is an exploded front view of said connector.

FIG. 1 shows an example in which connectors for a flat cable according to the present invention have a flat cable 4 connected by pressure contact to the terminal members $2_2$ the contacts 2 thereof, one connector Cl thereof being used to have an intermediate portion of the flat cable connected therewith and the other C2 thereof being used to have one end of the cable connected therewith.

Figure 7:
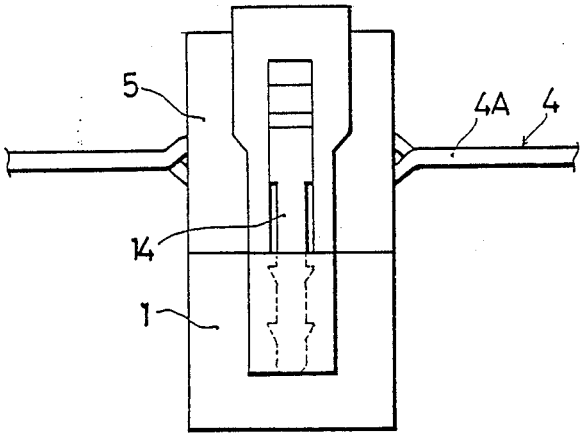
Figure 8:
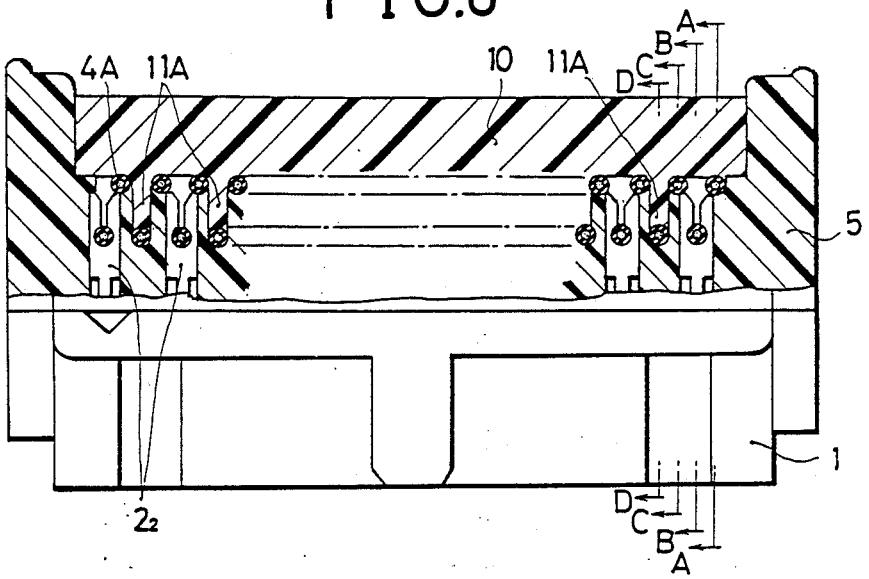
FIGS. 8 and 9 are sectional views taken respectively along the lines Y—Y and Z—Z in FIG. 6.
Figure 9:
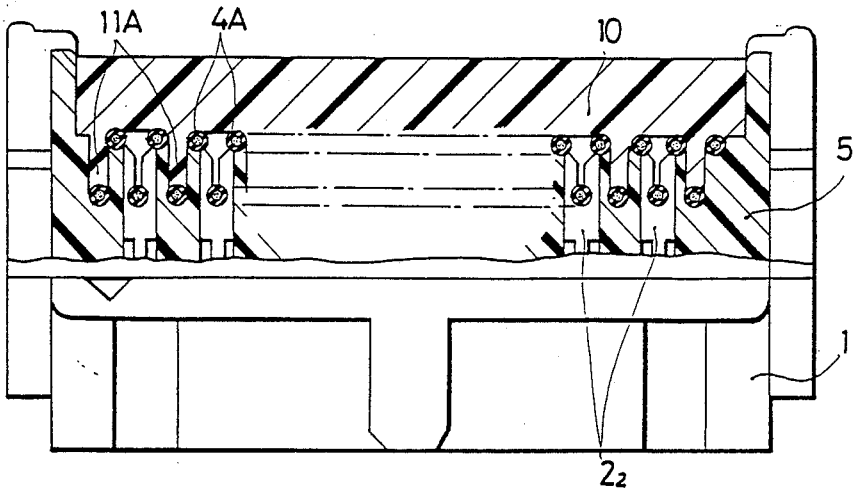
Figure 10:
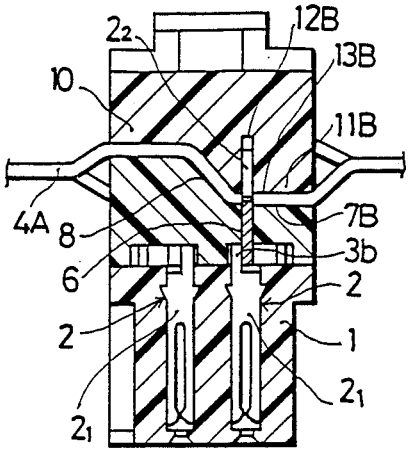
FIGS. 10, 11, 12 and 13 are sectional views taken respectively along the lines A—A, B—B, C—C and D—D in FIG. 8.
Figure 11:
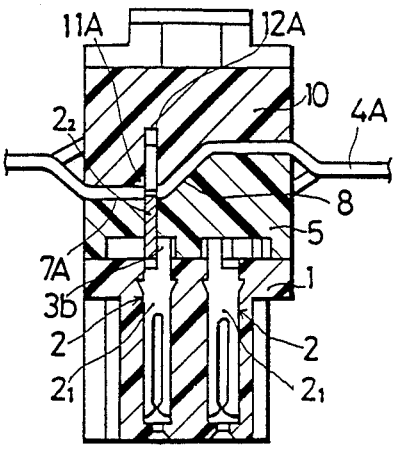
Figure 12:
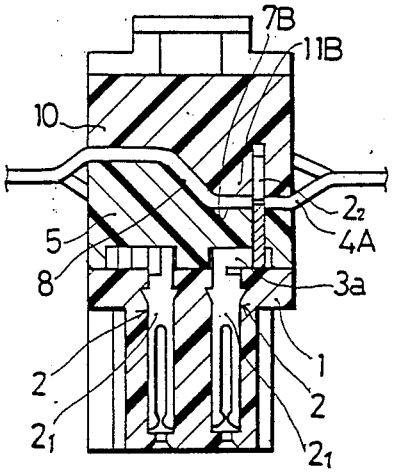
Figure 13:
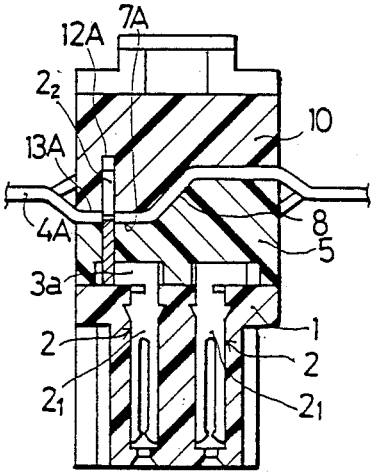
Figure 14:
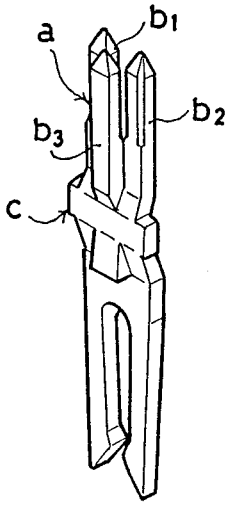
FIG.14 PRIOR ART
FIG. 14 is a perspective view of a contact of a conventional pressure-contact type connector for a flat cable.
Figure 15:
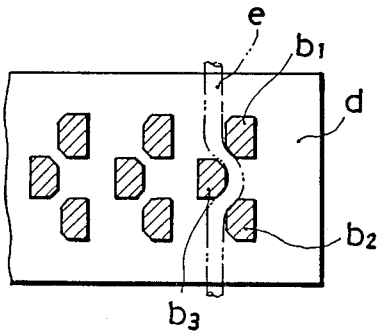
FIG.15 PRIOR ART
FIG. 15 is a plan view of said contacts thereof arranged in a contact housing.

The contact housing 1 and the first cable housing 5 are securely fastened to each other by driving in locking metal fittings 14 all the way through the first cable housing 5 and further into the contact housing 1. The locking metal fittings 14 are shaped so as to have a broader upper end portion as indicated in FIGS. 3 and 7. In FIGS. 3 and 6, a recessed portion 15 of the first cable housing 5 for receiving and guiding a projection 16 of the second cable housing 10.

As described in the foregoing, the connector according to the present invention provides such advantages that it is suitably used for connection of a flat cable comprising conductor wires arranged at such a small pitch as to be spaced very narrowly from one another. The contact pressure of the terminal member thereof towards the conductor wire of the flat cable is stronger. The operation to have the flat cable connected therewith is easier because of separation from one another, and bending, of the conductor wires of the cable are both performed when the second cable housing is being depressed downwards to bring the wires into pressure contact with the terminal members.

What is claimed is:

1. A pressure contact type connector for a flat cable wherein each conductor wire of a flat cable is pressed into a U-shaped terminal member having plate-form contacts housed in a contact housing comprising:

a plurality of U-shaped terminal members arranged in a first row and a second row, said terminal members in each of first and second rows being disposed to form a zigzag arrangement having a pitch twice as large as the pitch of the conductor wires of the cable;

said cable being arranged in a direction perpendicular to the direction in which the terminal members are arranged;

each one of the terminal members in a first row being disposed to be shifted by one conductor wire arrangement pitch with respect to the corresponding one in the second row;

a first cable housing having a height at least equal to the length of a portion of the terminal member projecting out of an end surface of the contact housing and including insertion through holes for the terminal members and a plurality of grooves disposed to cross the insertion through holes for receiving the terminal members and the conductor wire connecting portions for pressing into the terminal members;

both side edges of each strip-like top side surface between two adjoining side edges of said grooves being formed to make a cutting edge;

a second cable housing including a plurality of projections for mating with said plurality of grooves of the first cable housing, said projections being provided with insertion grooves for receiving the terminal members inserted thereinto; and both side edges of each of said projections of said second cable housing forming a cutting edge;

wherein the first cable housing is connected to the terminal members by inserting the terminal members through the insertion through holes, and the second cable housing is placed on the first cable housing via a flat cable and thereafter depressed to cause the plurality of projections thereof to be inserted into the plurality of grooves of the first cable housing, a plurality of conductor wires of the flat cable being separated from one another by the cutting edge of the first cable housing and the cutting edge of the second cable housing and brought into pressure contact with the terminal members for suitably bending and connecting the conductor wires.

2. The pressure contact type connector for a flat cable according to claim 1, wherein a U-shaped contact member, and the terminal member of the plate form contact are connected to each other wherein a planar face of one of the two is perpendicular to a planar face of the other.

3. The pressure contact type connector for a flat cable according to claim 1, and further including a locking fitting for retaining said first cable housing relative to said second cable housing.

4. The pressure contact type connector for a flat cable according to claim 1, wherein said first and second cable housing each include a front half and a rear half, said grooves in said front half being positioned at a distinct elevation relative to the grooves in said rear half.

5. The pressure contact type connector for a flat cable according to claim 4, and further including an inclined surface connecting said grooves on said front half to said grooves on said rear half.

* * * * *